United States Patent [19]

Gorman

[11] Patent Number: 4,585,461

[45] Date of Patent: Apr. 29, 1986

[54] METHOD OF MANUFACTURING A DIESEL FUEL ADDITIVE TO IMPROVE CETANE RATING

[76] Inventor: Jeremy W. Gorman, 5 Cedar Hill Rd., West Simsbury, Conn. 06092

[21] Appl. No.: 636,482

[22] Filed: Aug. 1, 1984

[51] Int. Cl.[4] ..... C10L 1/24

[52] U.S. Cl. ..... 44/53; 44/56; 44/57

[58] Field of Search ..... 44/57, 53, 56

[56] References Cited

U.S. PATENT DOCUMENTS 1,372,465 3/1921 Stevens ..... 44/56

2,785,662 3/1957 Boyce ..... 44/57

*Primary Examiner*—Y. Harris-Smith

*Attorney, Agent, or Firm*—Robert S. Smith

[57] ABSTRACT

A method of manufacturing a cetane improver, which includes providing a quantity of fusel oil, adding a substance which is substantially inert to a nitration process, substantially insoluble in water and soluble in fusel oil, and then separating water from the mixture and nitrating the mixture. The invention also includes the composition of matter which has application as a cetane improver which includes a mixture of from 5 to 25% ethyl nitrate and 16 to 33% isobutyl nitrate and 30 to 77% isoamyl nitrate mixed with fusel oil.

10 Claims, No Drawings

METHOD OF MANUFACTURING A DIESEL FUEL ADDITIVE TO IMPROVE CETANE RATING

BACKGROUND OF THE INVENTION

The invention relates to a "cetane improver" and a method for manufacturing this cetane improver. Cetane improvers are added essentially to all diesel fuel sold in the United States to increase their autoignition properties. Accordingly, the market for such cetane improvers is very large.

Cetane improvers have been used for at least 30 years. They were, for many years, almost exclusively amyl nitrate. The cost of amyl alcohol, from which the amyl nitrate is made, rose and so most of the major suppliers changed to either hexyl, which was used for a brief period of time, or to ethyl hexyl or octyl nitrate because it was cheaper. The alternatives have a higher molecular weight and therefore they are less effective for a given mass. However, because the price difference is now disproportionate to the difference in molecular weight the alternatives have better cost effectiveness.

In addition, lower molecular weight nitrates such as ethyl or propyl nitrates are unstable and hazardous to manufacture and ship.

There are octyl nitrates of two kinds, either the 2-ethyl hexyl nitrate or the n-octyl nitrate. There are only four primary suppliers in the United States. Octyl nitrate is a commodity product which is sold at the approximate rate of 130 million lbs. a year in the United States and the rate is growing by 3% a year. Its profit margin is low, as it is for most commodity items. Consequently small differences in raw materials or processing costs can make large differences in the ultimate cost for a given level of performance.

It is an object of the invention to provide a cost effective cetane improver.

Another object of the invention is to provide a very substantial market for an undesired by-product in the liquor industry—fusel oil.

It is still another object of the invention to minimize the hazard of manufacturing, shipping and storing of the finished product.

SUMMARY OF THE INVENTION

The foregoing objects and other objects and advantages which shall become apparent from the detailed description of the preferred embodiment are attained in a method of manufacturing a cetane improver, which includes providing a quantity of fusel oil; adding a substance which is (1) substantially inert to a nitration process, (2) substantially insoluble in water, and (3) soluble in both fusel oil and in the resulting nitrate; separating water from the mixture; and nitrating the mixture.

Fusel oil is defined as a mixture of higher fermentation alcohols with up to 20% water. Fermentation alcohol is ethanol containing varying amounts of isobutyl and isoamyl alcohol in the ratio of 1 to 3.

Fusel oil, a commercial waste product from the distillation of alcoholic beverages, is not usually nitratable as received. The further distillation to remove water, salt and ethanol is too expensive for commodity price structures. To circumvent the distillation, the method may include providing a substance such as a hydrocarbon. The hydrocarbon should be highly paraffinic, substantially free of aromatics and unsaturates, and may be diesel fuel. The method may further include the initial step of adding one salt of a very select group of salts to the mixture to precipitate water from the mixture. These salts must be very soluble in water, insoluble in fermentation alcohols, and low cost. The salt may be ammonium carbonate. A nitrating acid may be added to the fusel oil instead of visa versa. The hydrocarbon may be added in a proportion necessary to raise the average molecular weight to approximately a range of between 88 and 100.

The invention also includes the composition of matter which has application as a cetane improver. The composition includes a mixture of from 5 to 25% ethyl nitrate and 16 to 33% isobutyl nitrate and 30 to 77% isoamyl nitrate mixed with a liquid hydrocarbon. These proportions result from nitrating fusel oil.

DESCRIPTION OF THE PREFERRED EMBODIMENT

Fusel oil is a volatile, poisonous mixture of isoamyl, isobutyl, and ethyl alcohols produced as by-products in alcoholic fermentation of starches, grains, or fruits to produce ethyl alcohol. For example, fusel oil is a by-product in the process of aging wine and beer. Fusel oil is manufactured by all distillers merely because it is left over when they take out the ethyl alcohol they want. Liquor distillers just want to get rid of it. Fusel oil is foul smelling, quite toxic and one of the alcohol constituents is a teratogen, meaning a substance which may cause birth defects in any children of the person who has been exposed to the substance, and a suspected carcinogen. Fusel oils are primarily used as boiler fuel. Fusel oil's disadvantages as boiler fuel include (1) a 5 to 18% water content which severely hinders its burning, and (2) an oxygen content which reduces its BTU content substantially below gasoline, diesel fuel, number 2 fuel oil or number 4 fuel oil. Fusel oil can't be thrown away in sewers because it is too toxic.

One possible application is a nitration process for making cetane improvers, but this is not possible for two reasons. The primary reason is that fusel oil contains water and, thus, can not be nitrated. The second reason is that the United States government has numerous restrictions on substances which contains ethanol, such as fusel oil.

The ethanol could be separated from all other constituents by distilling. Distillers have tried such procedures and have found that the cost of distilling out the ethanol is more than the ethanol is worth. Thus, such a procedure is not cost effective.

The ethanol is not a disadvantage in the process in accordance with the invention, except that it lowers the molecular weight and requires approval from the U.S. Bureau of Alcohol, Tobacco and Firearms. Nitration is a highly exothermic process and, of course, the exotherm depends upon the molecular weight of the alcohol you nitrate. The lower the molecular weight the more nitrates per total mass you produce and therefore, the more exotherm you produce from the mass. When the exotherm is higher, the process is more dangerous because the finished nitrate products, such as ethyl nitrate or amyl nitrate, tend to be explosive in inverse proportion to their molecular weight. Such materials are liquids about as hazardous as nitroglycerine if their molecular weight is 76, but decreasingly so as the molecular weight reaches 174 (the molecular weight of octyl nitrate). "Fusel" nitrate has a molecular weight of 119 and is only moderately hazardous.

It has been discovered that if you add diesel oil to fusel oil, it dissolves, precipitating out the water. A nitration process on the fusel oil is then possible. The diesel oils are nitratable by this process only over long periods at high temperatures. Since it is not desirable to nitrate the diesel oil, the temperature is not raised. Thus, the diesel oil just acts as an inert solvent. Therefore the apparent molecular weight of the mixture is increased and the explosive hazard thereby reduced.

Known processes have not nitrated fusel oil directly. The invention includes the idea of adding a substance, such as diesel oil, to fusel oil to increase the apparent molecular weight, for nitration purposes and to precipitate water out of the fusel oil.

To evaluate the approach of adding diesel oil to fusel oil, 50 cc of fusel oil was added to a separatory funnel. Then 1 cc. of Compliance Diesel Oil was added to the separatory funnel and immediately caused a cloudy appearance. In 3 minutes no separation occurred. A second 1 cc. of Compliance Diesel Oil was added, cloudiness increased but no short term separation occurred. Then 3 cc. more of Compliance Diesel oil (10% total) was added. The cloudiness persisted. The mixture was left standing. After 3 hrs. separation had occurred. The bottom layer had an index of refraction of 7.5 (Brix), indicating about 16.5% ethanol. The bottom layer was only about 1 cc., indicating that 10% diesel oil was not a large enough percentage for optimum results. Another 5 cc. of Compliance Diesel Oil was added. The cloudiness persisted and then settling occurred and a separate 1 cc. lower layer formed, which again had a refractive index of 7.2 (Brix) indicating 15% alcohol.

The lower layer was drained and 5 cc. more of Compliance Diesel Oil was added. The mixture again turned cloudy, indicating further precipitation of water. When that settled, after 1 hour, about 1 cc. settled out and gave an index of refraction of 7.5 (Brix), indicating about 16% alcohol.

Cooling produced no additional separation.

2% by weight of $(NH_4)_2CO_3$ was added to form a white wet slurry. Too much $(NH_4)_2CO_3$ formed to dissolve in the remaining water.

The composition of the nitrated product in accordance with the invention is called fusel nitrate. This composition is preferred because it has a lower cost than the octyl nitrate and it has a lower molecular weight. Therefore, the composition in accordance with the invention can outperform the prior art by about 25% on a weight basis and even more so on a cost basis.

Fusel oil is believed not to have been nitrated directly, primarily because of the water content and perhaps also because of the salt and ethyl alcohol impurities. Although diesel fuel has been primarily described as the additive, these problems are solved in the process in accordance with the invention by adding a hydrocarbon. Diesel fuel is preferred because the final product will be mixed into diesel fuel and diesel fuel is also very low in cost.

Diesel fuel contains some aromatic, some naptha, and some unsaturated hydrocarbons, all of which are very mildly active to the nitration process. The process tends to make some gums and tars and such. If nitration is done cold, with high nitric and minimum sulfuric acid, not many such tars, gums and the like are formed, and they aren't difficult to manage. The fusel oil mixture does tend to get rather dark, and if you leave the reaction mixture around too long and if it gets too warm black tars will form.

Ideally, the additive is some low molecular weight hydrocarbon. The more paraffinic the hydrocarbon the better, because it will be more inert to nitration. The preferred method does include the use of diesel fuel. Any hydrocarbon which is totally miscible with fusel oil and basically immiscible with water so that it will precipitate the water out is fine. The preferred hydrocarbon molecule has around 12 to around 28 carbon atoms. If the number of carbon atoms gets too high, it begins to become immiscible, even with fusel oil. Above 30 carbons the substance becomes viscous and hard to manage. Accordingly, the lighter ones are preferred.

The required characteristics of the hydrocarbon are (1) the substance is reasonably inert to the nitration process, (2) is insoluble in water so the water separates out, and (3) the substance must be soluble in fusel oil. These are the only requirements. The substance need not be a hydrocarbon.

The dehydration process can be helped along a small amount of a salt. The salt must have very high solubility in water (over 50%) and essentially no solubility in alcohols. Several such salts are ammonium carbonate, potassium carbonate, diammonium phosphate, and sodium bisulphate. Low cost is also critical. The salt addition not only helps dehydrate the fusel oil, but remarkably shortens the time for natural separation of the water from the remaining fusel oil.

There are a number of salts which are very soluble in water, but are also soluble in alcohol. These salts are not useable. Some salts are very insoluble in alcohol and have limited solubility in water. These are not useable either.

Ammonium carbonate is preferred because very small quantities are required and because in any fermentation process carbon dioxide is produced as a by-product. If that carbon dioxide is trapped in water and then ammonia is added, you generate very low cost ammonium carbonate, because ammonia, the only constituent having any cost, has an extremely low price. Ammonia is only 35% of ammonium carbonate. This aspect of the invention is advantageous because it is highly economical.

The preferred hydrocarbon is diesel fuel because, in part, it is very cheap. Although Exxon Isopar (primarily an aliphatic hydrocarbon) costs more, it will also work very well. The effectiveness can be increased by combining the two dehydrating techniques, salting out the water by adding a little of the ammonium carbonate followed by hydrocarbon treatment. The addition of 0.50% ammonium carbonate to the fusel fuel will eliminate substantially all water. Now nitration can occur. In addition, ammonium carbonate will not interfere with the nitration process because as it gets warm it becomes volatile. Ammonium carbonate decomposes into ammonia and carbon dioxide which boil off.

Using salt is not a requirement. Experiments have demonstrated the utility of the method even without using any salt, just mixing the diesel oil and the fusel oil. Alternatively, the water may be removed exclusively by using the salting out process, yielding dehydrated fusel oil.

The invention produces a low cost product, which has a lower average molecular weight, and performs very very well as a cetane improver.

Fusel oil has both advantages and disadvantages in the nitration process. The nature of such slightly higher molecular weight alcohols is that the water solubility is limited. Fusel oil dissolves about 9% water, which means that it tends not to blend very well with the mixed acids of the nitration process. Thus, there is a two phase instead of a single phase reaction. The disadvantage is that the reaction tends to be hard to start and is slow initially. Once the reaction gets going it wants to run away. The advantage is that because of the higher molecular weight and the presence of a fuel oil the exotherm tends to be small so the reaction doesn't tend to be violent. In addition, the average molecular weight of the product is high enough so that it is not in the explosive class.

The preferred average molecular weight prior to nitration is between 88 and 100. The average molecular weight of the dry fusel oil is about 74. Accordingly, about 12% diesel oil is added, bringing the average molecular weight up to the ideal 88–90 range. Octyl alcohol, the product which is now currently used, has a molecular weight of 130 and, thus, the method and composition of the invention has a substantial performance advantage.

It is sometimes preferable, in the nitration process, to reverse the usual nitration procedure and add the nitrating acid to the fusel oil instead of the other way around. This approach avoids a tendency to form heavy tars as when conventional procedures are used. It is still better to add the fusel oil reactant to nitric acid only until the water formed as a by-product of the reaction stops the reaction, following with mixed acids. Test data showing the invention follows:

EXAMPLE I

To 85 Grams of fusel oil (index of refraction 1.3926), there was added 15 grams of Compliance Diesel Oil. The mixture immediately turned cloudy, but in one hour 5 grams of a heavier, clear fluid (IR=1.3573) had settled out and was drained off. This index of refraction indicates a composition which was about 12% ethanol.

To the remaining mixture, consisting substantially of fusel oil and diesel oil, was slowly added a mixture of 98 grams of 70% nitric acid and 180 grams of 98% sulfuric acid. After about ⅔ of the mixture was added, the exotherm became excessive and the combination boiled out of the flask in which it was disposed. The reaction stopped when no further acid was added. The upper layer was washed four times with its own volume of water in a separatory funnel. The final product was dark amber (IR=1.4316) and calculated to be a 62.8% solution of fusel nitrate (IR=1.4062) in diesel oil. Had the reaction been completed, the solution would have contained 89.7% fusel nitrate. This mixture would be a 70% solution of fusel nitrate in diesel oil.

Since the performance curve of cetane improvers is not a straight line, it was decided that it would be a more accurate test of performance against the commercial octyl nitrates, because they have about the same average molecular weight. (This sample MW=189, octyl nitrate MW=174).

The following samples were submitted for cetane performance tests in a diesel engine:

| SPECIMEN | CETANE NUMBER |
|---|---|
| 1. Compliance diesel oil | 44.0 |
| 2. Compliance diesel oil with 3.5cc./gal. of 62.8% solution of Example 1 | 49.5 |
| 3. Compliance diesel oil with 3.5cc./gal. "Ethyl DII (octyl nitrate) | 49.5 |
| 4. Compliance diesel oil with | 49.5 |

-continued

| SPECIMEN | CETANE NUMBER |
|---|---|
| 3.5cc./gal. "Nalco 5308" (octyl nitrate) | |

It will be seen that a 62.8% solution works as well as competitive undiluted additives. Since the diluted composition of the invention can be made cheaper and it works better than competitive undiluted mixtures, it follows that the undiluted solution in accordance with the invention is more cost effective.

EXAMPLE II

To 100 cc. of fusel oil (approximately 83 grams) there was added 178 gram of powdered ammonium carbonate. The mixture immediately turned cloudy. The solid matter dissolved in 10 minutes. In one hour a lower layer had settled out and two clear layers remained. The lower layer was only 2½ cc. and had an index of refraction of 13 (Brix), indicating a 13.4% solution of ammonium carbonate in water. This indicates that there were only 3.7 grams of water in the fusel oil (4.4%), and that 0.9 grams (1.1%) remained dissolved in the fusel oil. This mixture, however, readily nitrated in mixed acids, yielding a product with an index of refraction of 1.4062 (43.3 Brix).

EXAMPLE III

To 100 cc. of fusel oil (83 grams) was added ½ gram of powdered potassium carbonate. The solids dissolved quickly and began separating into two layers within two minutes. The lower layer was 14.5% potassium carbonate, indicating 2.9 grams water (3.5%). The upper layer nitrated easily, yielding a product with an index of refraction of 1.4060 (43.2 Brix).

EXAMPLE IV

To 100 cc. of fusel oil there was added 10 cc. of Exxon Isopar K. The solution immediately turned cloudy and was slow to settle. In four hours a lower layer of 3.0 cc. had formed with an index of refraction of 8 (Brix), indicating about 17% ethanol. The upper layer nitrated easily, however, and gave a product with an index of refraction of 1.4074 (43.9 Brix).

The invention has been described with reference to its illustrated preferred embodiment. Persons skilled in the art may, upon exposure to the teachings herein, conceive variations in the components therein. Such variations are deemed to be encompassed by the disclosure, the invention being delimited only by the appended claims.

Having thus described my invention, I claim:

1. A method of manufacturing a cetane improver, which comprises:

providing a quantity of fusel oil;

mixing a highly paraffinic hydrocarbon which is substantially free from aromatics and unsaturates, said hydrocarbon having a molecule which contains from 12 to 28 carbon atoms and 22 to 58 hydrogen atoms and which is (1) substantially inert to a liquid phase nitration process, (2) substantially insoluble in water, and (3) soluble in fusel oil, this mixing step causing separation of water from the fusel oil; and nitrating the mixture by the intermixing of the above mixture with a mixture of nitric and sulfuric acid in the liquid phase.

2. A method of manufacturing a cetane improver, which comprises:

providing a quantity of fusel oil;

mixing diesel oil to separate water from the fusel oil; and nitrating the mixture by the intermixing of the above mixture with a mixture of nitric and sulfuric acid in the liquid phase.

3. The method as described in claim 2, further including:

the step of adding a salt to the mixture to precipitate water from the mixture.

4. The method as described in claim 3, wherein:

the salt is insoluble in lower ($C_1$–$C_7$) alcohols, but is soluble in water at least to 50% of the weight of the dissolving water.

5. The method as described in claim 4, wherein:

the salt is ammonium carbonate.

6. The method as described in claim 5, wherein:

a nitrating acid is added to the fusel oil instead of visa versa.

7. The method as described in claim 6, wherein:

the inert hydrocarbon is added in a proportion necessary to raise the average molecular weight of the nitratable composition to an approximate range of between 88 and 100.

8. The method as described in claim 4, wherein:

the salt is potassium carbonate:

9. The method as described in claim 4, wherein:

the salt is diammonium phosphate.

10. The method as described in claim 4, wherein:

the salt is sodium bisulphate.

* * * * *